US005123362A

United States Patent [19]

Kikuchi

[11] Patent Number: 5,123,362

[45] Date of Patent: Jun. 23, 1992

[54] HIGH TEMPERATURE-GENERATING METHOD AND APPLICATION THEREOF

[75] Inventor: Masaichi Kikuchi, Nabari, Japan

[73] Assignee: Shiro Shirakawa, Tokyo, Japan

[21] Appl. No.: 613,757

[22] PCT Filed: Apr. 17, 1990

[86] PCT No.: PCT/JP90/00497

§ 371 Date: Dec. 14, 1990

§ 102(e) Date: Dec. 14, 1990

[87] PCT Pub. No.: WO90/12984

PCT Pub. Date: Nov. 1, 1990

[30] Foreign Application Priority Data

Apr. 17, 1989 [JP] Japan ..... 1-97213
Mar. 12, 1990 [JP] Japan ..... 2-57886

[51] Int. Cl.[5] ..... F23B 7/00; F23C 5/00

[52] U.S. Cl. ..... 110/341; 431/2; 431/8

[58] Field of Search ..... 431/2, 8; 110/341

[56] References Cited

U.S. PATENT DOCUMENTS 3,269,446 8/1966 Luther ..... 431/2
3,306,338 2/1967 Wright et al. ..... 431/2
3,749,545 7/1973 Velkoff ..... 431/8
3,841,824 10/1974 Bethel ..... 431/8
3,842,015 10/1974 Vogt et al. .
4,052,139 10/1977 Paillaud et al. ..... 431/2
4,260,583 4/1981 Sanclemente ..... 431/2

FOREIGN PATENT DOCUMENTS 49-38653 10/1974 Japan .
55-46370 4/1980 Japan .
63-247511 10/1988 Japan .
63-283751 11/1988 Japan .

*Primary Examiner*—Henry C. Yuen
*Attorney, Agent, or Firm*—Finnegan, Henderson, Farabow, Garrett & Dunner

[57] ABSTRACT

A flame-ionizing material formed by molding a composition comprising a magnetic substance and a substance, the specific electric resistance of which is varied under irradiation with radioactive rays, and sintering the molded body in an oxidative atmosphere, has a function of ionizing a flame when the flame is brought into contact with this flame-ionizing material, and if a magnetic field is applied to the flame, a plasma flame having a higher temperature can be formed. Accordingly, this high temperature-generating means and method are valuable in fields where a high temperature is required, for example, for an incineration of industrial wastes and decomposing matter containing a large quantity of water, and the metallurgical and ceramic fields.

8 Claims, 5 Drawing Sheets

HIGH TEMPERATURE-GENERATING METHOD AND APPLICATION THEREOF

TECHNICAL FIELD

The present invention relates to a material having a function of ionizing a combustion flame of a hydrocarbon, and an application thereof. According to the present invention, a high-temperature plasma flame can be generated without using an electric discharge, and thus the present invention can be valuably utilized in industrial fields where a high temperature is required, for example, an incineration of industrial wastes and decomposing matter or putrefactions containing a large quantity of water, and the metallurgical and ceramic fields. Furthermore, it is considered that the flame ionizing material of the present invention will be able to be used as an ion-generating source for an ion-propelled engine or as a semiconductor.

BACKGROUND ART

In industrial fields where a high-temperature treatment is necessary, a plasma has been heretofore utilized as the high temperature-generating means, and since the conventional plasma-generating method utilizes an electric discharge, it has a basic problem in that a large amount of electric power is necessary, and further, the method is disadvantageous in that the means for generating the plasma is complicated and expensive.

Alternatively, a method in which a hydrocarbon is burnt by using a catalyst comprising specific metals in combination is known (see, for example, U.S. Pat. No. 3,842,015), Japanese Examined Patent Publication No. 61-20764 and Japanese Unexamined Patent Publication No. 63-283751), but this method is directed to the treatment of automobile exhaust gas or factory exhaust gas, and the combustion temperature is 1500° C. at highest.

DISCLOSURE OF THE INVENTION

Accordingly, a primary object of the present invention is to provide a means for generating a plasma at a high efficiency without utilizing an electric discharge. A secondary object of the present invention is to provide a method by which a prompt and efficient incineration of wastes is carried out, as a typical instance of a utilization of a high temperature generated by the above-mentioned means.

The primary object of the present invention, i.e., a generation of a plasma without utilizing an electric discharge, is attained by a material having a function of ionizing at least a part of a combustion flame of a hydrocarbon when the combustion flame comes into contact with the material (this material will be called "flame-ionizing material" hereinafter). The second object of the present invention, that is, the method of generating a high temperature without utilizing an electric discharge, is attained by causing a combustion flame of a hydrocarbon to come into contact with this flame-ionizing material.

BEST MODE OF CARRYING OUT THE INVENTION

Figure 1:
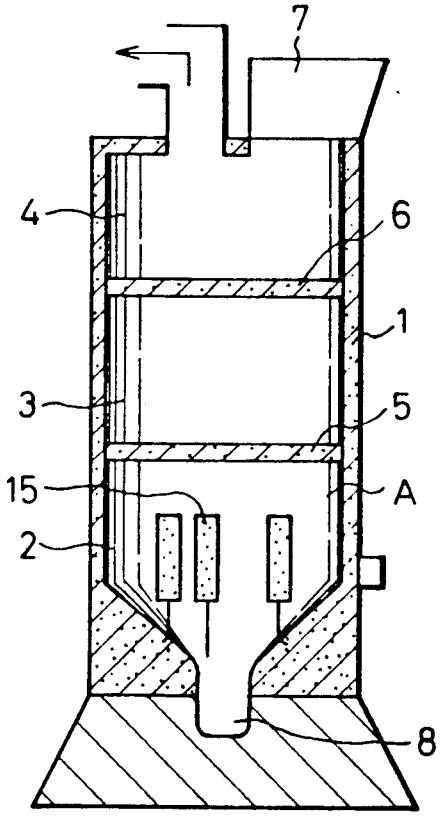
FIG. 1 through 3 are schematic diagrams illustrating an incinerator utilizing the method of the present invention.

The flame-ionizing material of the present invention is provided by sintering in an oxidative atmosphere a composition comprising a magnetic material and, incorporated therein, a substance, the specific electric resistance of which is varied under irradiation with radioactive rays (hereinafter referred to as "optically active substance"). As the optically active substance, there can be mentioned, for example, simple substances and compounds such as oxides, sulfides and halides of selenium, cadmium, titanium, lithium, barium and thallium. As the magnetic material, there can be used ferromagnetic materials (for example, iron, nickel and cobalt, and compounds thereof), paramagnetic materials (for example, manganese, aluminum and tin, and compounds thereof), and diamagnetic materials (for example, bismuth, phosphorus, copper and calcium, and compounds thereof). The mixing ratio of the magnetic material to the optically active substance is 5 to 40% by weight, preferably 8 to 30% by weight.

This composition is generally mixed with a binder, molded into a desirable shape such as a rod or sphere, and sintered. Binders customarily used in the ceramic industry, for example, clay, calcium carbonate, calcium oxide, kaolin and acid clay, can be optionally used. The amount used of the binder is generally about 1 to about 2 times the amount of the above composition.

Sintering of the molded body is carried out in an oxidative atmosphere in an electric field at a temperature higher than 1500° C., preferably 1800° to 2000° C. As the calcination is advanced, the molded body gradually exerts an ionizing function, and it is found that the firing atmosphere is accordingly ionized and the temperature of the firing atmosphere is elevated to a high level. Thus, the above-mentioned material is polarized to some extent only by firing and therefore, can be used as the flame-ionizing material. Nevertheless, preferably the polarization degree is increased by carrying out the polarizing treatment at or after the firing operation. The polarization can be effected even at normal temperature by placing the molded body under a high voltage for a considerable time. If a voltage is applied at a high temperature, the polarization equivalent to that at normal temperature can be attained under a lower voltage. The polarization degree is not particularly critical, but preferably the polarization degree is about 5 to about 20 mV.

According to the high temperature-generating method, which is the first application of the flame-ionizing material of the present invention, the flame-ionizing material constructed in the abovementioned manner is brought into contact with a combustion flame of a hydrocarbon. As the hydrocarbon, there can be used not only usual fuels such as fuel oil, kerosine and alcohols, but also mixtures formed by adding water or coal powder to these fuels for improving the combustion efficiency. No contrivance need be made to the method of the combustion of these hydrocarbons, and oxygen necessary for the combustion is generally supplied in the form of air. The supply of air in an amount larger than the amount necessary for the combustion is preferable, because the efficiency of the contact with the ionizing material is increased.

By the contact with the ionizing material of the present invention, the combustion flame is ionized to produce a plasma state, but this state is extinguished in a relatively short time and the flame revets to usual neutral flame. Application of a magnetic field to the combustion flame is a means effective for stabilizing the plasma state for a time as long as possible, and if this means is adopted, a long-time continuation of a high temperature becomes possible. If a high-frequency magnetic field is used as the magnetic field and is rendered rotational, an increase of the energy can be easily attained. The intensity of the magnetic field is not particularly critical, but from the practical viewpoint, a flux density of at least 10000 G and a frequency of 20 to 50 MHz are preferably adopted. This is because $H_2O$ and $CO_2$ bonded by the combustion are ionized to prevent a re-bonding thereof. A high-frequency magnetic field as mentioned above is suitable for imparting an energy larger than the bonding energy of $H_2O$ and $CO_2$. A higher magnetic field can be used, but this is not advantageous from the economical viewpoint.

If irradiation with X-ray, $\alpha$-rays, $\beta$-rays, $\gamma$-rays, ultraviolet rays, infrared rays and visible rays (preferably, radiations having an energy larger than that of infrared rays) is carried out simultaneously with the above-mentioned application of the magnetic field, the flame is more easily ionized and the ionization state is more stabilized. Therefore, this irradiation is preferred.

For bringing the combustion flame into contact with the flame-ionizing material, there is usually adopted a method in which a flame from flame-generating means (an ordinary burner can be used) is caused to impinge against the flame-ionizing material placed in a combustion furnace. According to another embodiment, a flame-generating means lined with the flame-ionizing material is used, and the flame is introduced into the furnace while being contracted with the flame-ionizing material.

As apparent from the foregoing description, the apparatus for use in carrying out the high temperature-generating method of the present invention should be equipped with a flame-ionizing material and a means for generating a flame by burning a hydrocarbon, and preferably from the industrial viewpoint, the apparatus is further equipped with a magnetism-generating means and with a radioactive ray-irradiation means. The apparatus for use in carrying out the above-mentioned another embodiment comprises a flame-injecting cylinder having the flame-ionizing material arranged on the inner surface. In the apparatus equipped with this flame-generating means, the arrangement of the flame-ionizing material in the combustion furnace can sometimes be omitted. The flame-ionizing material of the present invention and the high temperature-generating method and apparatus as typical instances of the utilization of the flame-ionizing material have been described. The present invention will now be described while taking an incinerator as an example with reference to the accompanying drawings.

FIG. 1 is a conceptual diagram illustrating the longitudinal section of an incinerator provided with the flame-ionizing material 15 of the present invention. The incinerator consists of a cylindrical refractory furnace 1, in which a plasma chamber 2, a psuedo-plasma chamber 3 and a neutral flame chamber 4 are arranged in order from the bottom, and porous fire grate bars 5 and 6 are arranged between adjacent chambers. Namely, the combustion flame is brought into contact with the flame-ionizing material 15 in the plasma chamber 2 to form a plasma flame, and while the plasma flame rises, it is converted to a pseudo-plasma flame in the pseudo-plasma chamber 3 and almost to a neutral flame in the neutral flame chamber 4. A waste to be incinerated is thrown into the cylindrical refractory furnace 1 from a throwing opening 7 formed at the top of the furnace 1, is dried and burnt by the neutral flame in the neutral flame chamber 4 and is burnt at a higher temperature by the pseudo-plasma flame in the pseudo-plasma. In the plasma chamber 2, the temperature is further elevated and complete combustion is performed. A discharge opening 8 is formed at the furnace bottom to withdraw incineration ash and incombustibles, but if necessary, a screw conveyor can be arranged to withdraw the incineration ash. In FIG. 1, a lift for lifting up the waste to the furnace top and a device for forced exhaustion are omitted.

Figure 2:
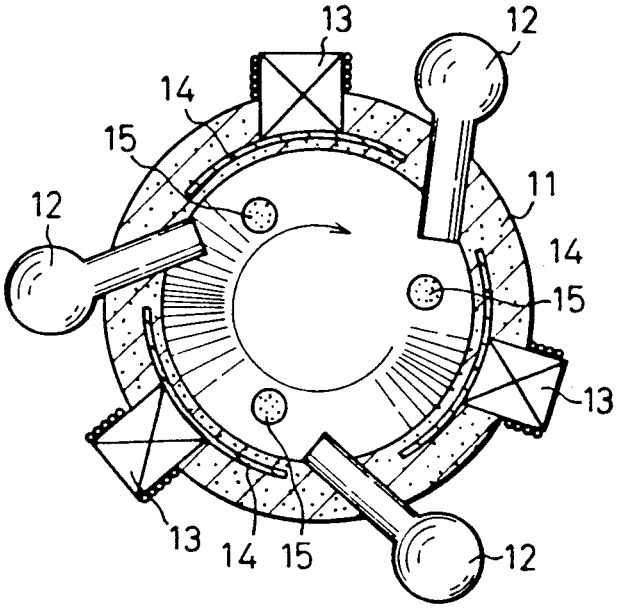
Figure 3:
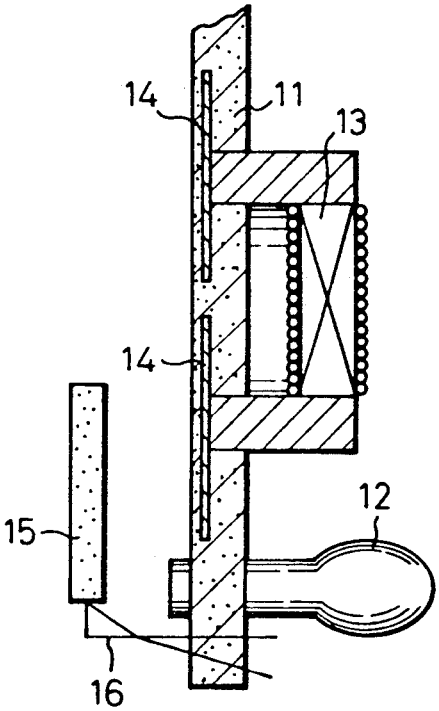

FIGS. 2 and 3 are diagrams illustrating in detail the cross-section and longitudinal section of the plasma chamber 2. Three burners 12 and three electromagnetic coils 13 are equidistantly arranged on a furnace wall 11, and the burners 12 are disposed so that flames are rotated to the right, and iron cores 14 of the electromagnetic coils 13 are embedded in the furnace wall 11. The flame-ionizing member 15 is arranged in front of each burner 12. In this embodiment, three burners 12 and three flame-ionizing members 15 are arranged. Note, only one each of the burner and flame-ionizing member may be arranged, and the burner may be directed to the center of the cylinder. The burner 12 may be a commercially available burner of the type where fuel oil or kerosine is used as the fuel and an air/fuel mixture is injected.

Figure 4:
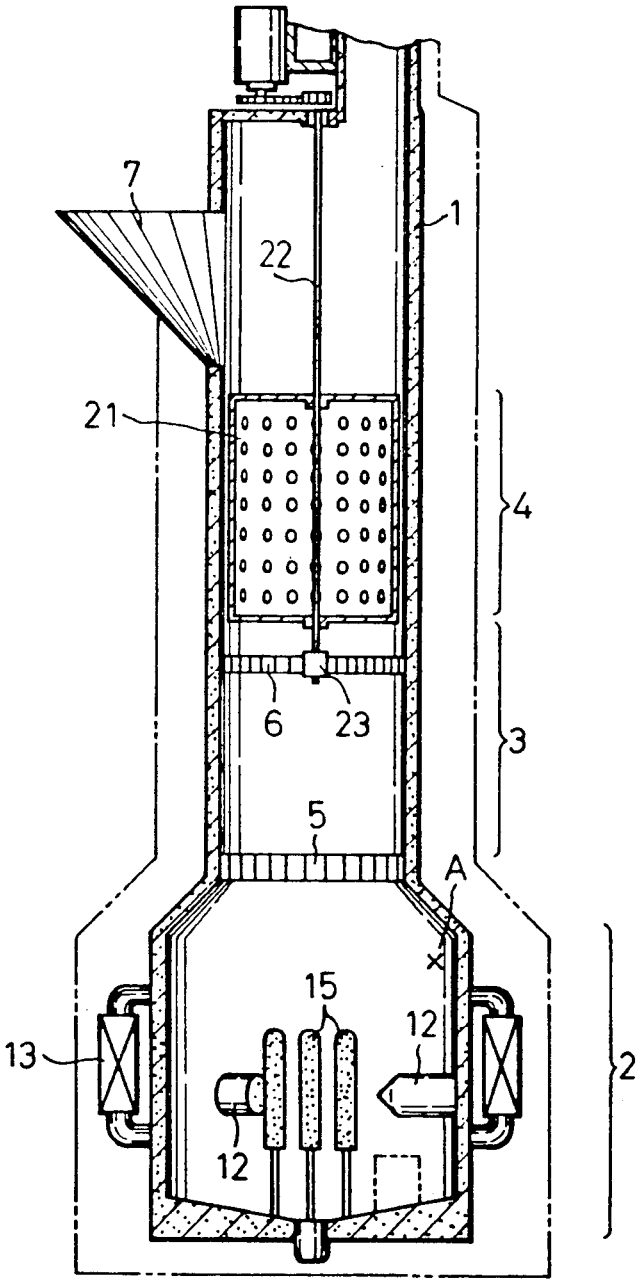
FIG. 4 is a schematic diagram illustrating a modification of this incinerator.

FIG. 4 shows modification of the incinerator shown in FIGS. 1 through 3, i.e., an incinerator suitable for the incineration of a waste having a high water content, such as fish entrails or decomposing matter. The principle of this modification is the same as that of the above-mentioned embodiment, but in this modification, a containing cage 21 composed of a heat-resistant metal is arranged in the neutral flame chamber to effect dehydration, and many window holes are formed in the containing cage 21 and the lower end portion of a driving shaft 22 is supported on a carbon bearing 23 to rotate the containing cage 21 around the driving shaft 22. The carbon bearing 23 is formed by kneading a 7/3 mixture of graphite/silicon nitride with an alkaline solution and sintering the kneaded mixture at about 1800° C. for about 10 hours in an oxygen-free state and is contained in a stainless steel casing.

Entrails and the like are supplied into the containing cage 21, and the containing cage 21 is rotated by a rotating torque applied to the driving shaft 22, whereby the entrails are dehydrated and the decomposed entrails are shaken out from the window holes. Since the entrails are shaken out in proportion to the centrifugal force, the feed rate of the decomposed entrails to the lower stage can be controlled by controlling the rotation number.

Figure 5:
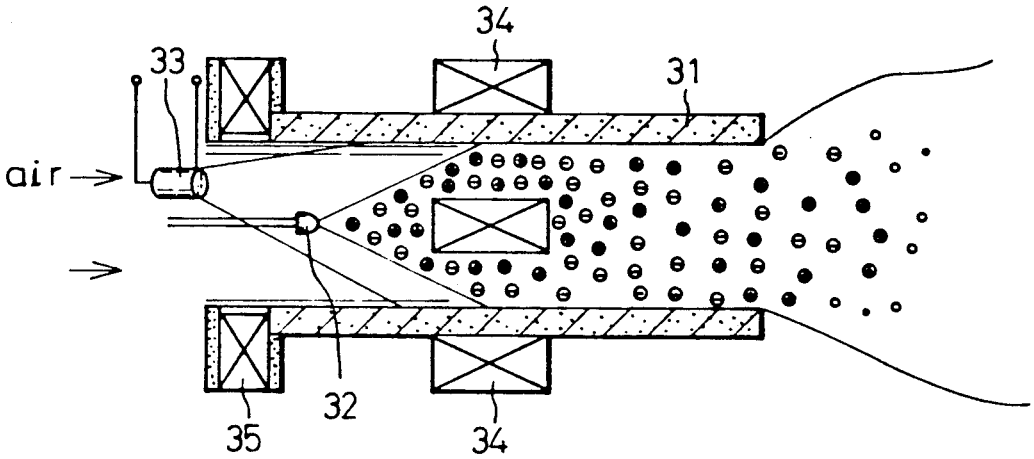
FIG. 5 and 6 are schematic diagrams illustrating a burner used in the method of the present invention.

FIG. 5 is a diagram showing still another embodiment of the contact between the flame-ionizing material and the flame. A combustion flame jetted from a fuel injection nozzle 32 arranged in the interior of a flame injection cylinder 31 having the inner surface lined with the flame-ionizing material is brought into contact with the flame-ionizing material and is at least partially ionized. Simultaneously, the flame is irradiated with radioactive rays (X-rays) emitted from a radiation tube (for example, an X-ray tube) 33 arranged in the rear of the fuel injection nozzle 32. Furthermore, high-frequency magnetic fields are applied to the flame by first electromagnetic coils 34 equidistantly arranged around the flame injection cylinder 31 and second electromagnetic coils 35 arranged in the rear of the fuel injection nozzle 32, whereby the ionization of the flame is promoted and stabilized and a high-energy state is maintained.

Figure 6:
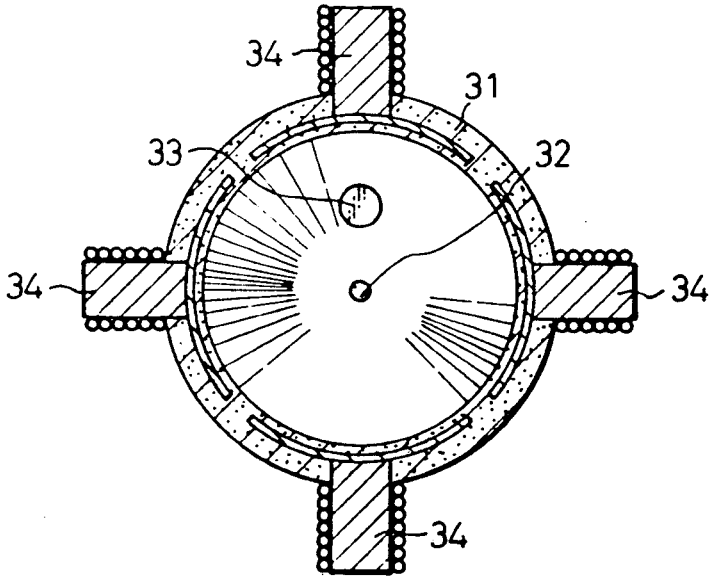

FIG. 6 is a view of the burner of FIG. 5 seen from the injection opening side of the flame injection cylinder 31. This burner can be used as the burner 12 in the embodiment shown in FIGS. 1 through 3, and in this case, the arrangement of the flame-ionizing material 15 in the incinerator can be omitted.

Figure 7:
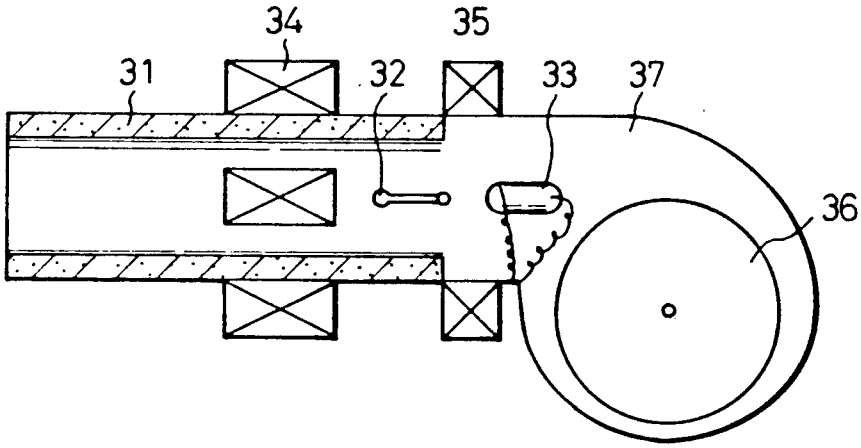
FIG. 7 is a conceptual diagram illustrating a modification of this burner.

FIG. 7 shows a modification of the apparatus shown in FIG. 5. A sirocco fan 36 is arranged in the rear of the fuel injection nozzle 32 and radiation tube (for example, an X-ray tube) 33. Since this flame-generating apparatus is of a small burner type, this can be conveniently used as the burner in the embodiment shown in FIG. 1 or 4.

Figure 8:
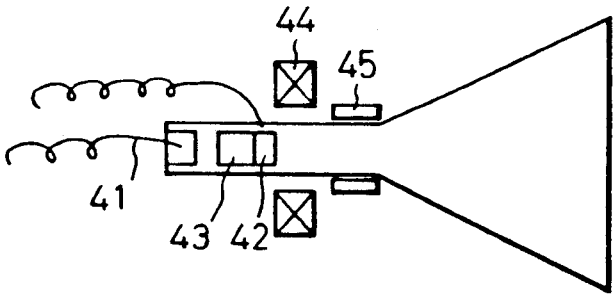
FIG. 8 is a conceptual diagram illustrating an electron beam emission tube.

FIG. 8 shows an example of the electron beam-generating apparatus, which comprises a negative electrode 41, a positive electrode 42, a control grid 43, a convergent coil 44 and a deflection coil 45. A voltage of 15 to 30 kV is applied between the negative and positive electrodes to electrify the convergent coil 44 and deflection coil 45, whereby high-speed electron beams are emitted from the front surface. A commercially available Tv Braun tube can be used as this electron beam-generating apparatus. Furthermore, an X-ray emission tube is marketed and is easily available.

When a combustion flame of a hydrocarbon or the like is brought into contact with the flame-ionizing material of the present invention, the flame is ionized to produce a plasma state, and a much higher temperature than the temperature attainable in other case can be realized. If a magnetic field is further applied in this state, the plasma is stably maintained. Accordingly, such a high temperature as 3000° to 4000° C. can be attained without utilizing any electric discharge means.

The present invention will now be described in detail with reference to the following examples that by no means limit the scope of the invention.

EXAMPLES 1 THROUGH 6

An optically active substance, a magnetic material and a binder were mixed at a weight ratio shown in Table 1, and the mixture was molded into a rod and sintered according to customary procedures to obtain a flame-ionizing material of the present invention.

A flame formed by burning fuel oil as a fuel by a commercially available burner was brought into contact with this flame-ionizing material, and the temperature was measured by an optical pyrometer. The results are shown in Table 1.

TABLE 1

Components of Flame-Ionizing Material and High Temperature-Generating State

| | Example No. | | | | | |
|---|---|---|---|---|---|---|
| | 1 | | 2 | | 3 | |
| Composition | component | parts by weight | component | parts by weight | component | parts by weight |
| Optically active substance | $TiO_2$ | 100 | $TiO_2$ | 100 | SeS | 100 |
| magnetic material | Fe | 1.5 | Fe | 1.8 | Ni | 1.6 |
| | Mn | 2.5 | Al | 0.8 | Sn | 2.2 |
| | Na | 10.5 | Na | 10.0 | Ca | 13.3 |
| binder | calcium carbonate | 150 | clay | 50 | kaolin | 100 |
| | | | calcium carbonate | 50 | calcium carbonate | 50 |
| voltage* (mV) | 5.5-6.5 | | 5.3-6.1 | | 5.0-6.2 | |
| attained temperature** (°C.) | 2800 | | 2800 | | 2800 | |
| time** (minutes) for attainment of highest temperature | 15 | | 15 | | 15 | |
| Remarks | high temperature stably maintained | | same as in Example 1 | | same as in Example 1 | |

| | Example No. | | | | | |
|---|---|---|---|---|---|---|
| | 4 | | 5 | | 6 | |
| Composition | component | parts by weight | component | parts by weight | component | parts by weight |
| Optically active substance | $TiO_2$ | 100 | SnS | 100 | $TiO_2$ | 100 |
| magnetic material | Ni | 2.5 | Ni | 4.0 | Fe | 0.3 |
| | Mn | 6.0 | Mn | 1.0 | Mn | 0.4 |
| | Cu | 10.0 | Na | 7.0 | Na | 5.6 |
| binder | calcium carbonate | 100 | clay | 100 | clay | 50 |
| | | | | | calcium carbonate | 50 |
| voltage* (mV) | 4.8-6.0 | | 2.6-3.0 | | 2.8-3.1 | |
| attained temperature** (°C.) | 1800-2800 | | 1700-2600 | | 1800 | |
| time** (minutes) for attainment of highest temp- | 15 | | 15 | | 60 | |

TABLE 1-continued

| Components of Flame-Ionizing Material and High Temperature-Generating State | | | |
|---|---|---|---|
| erature | | | |
| Remarks | highest temperature rose and dropped unstably | same as in Example 4, low durability of flame-ionizing material | long time for arrival at highest temperature |

Note
*element electrode distance was 1 mm and electrode material was nickel
**comparison (flame-ionizing material was not used). 1600° C. (60 minutes)

EXAMPLE 7

Medical wastes (fibers such as bandages and adsorbent cotton, rubber articles such as gloves and tubes, glass bottles, metals such as injection needles and cans, and the like) discharged from a medium-scale hospital were thrown into the incinerator shown in FIG. 1, to which the flame-ionizing material of Example 1 was attached, and the incineration test was carried out. The results are shown in Table 2. In the comparison, the flame-ionizing material was not used.

TABLE 2

| Results of Incineration Test of Medical Wastes | | |
|---|---|---|
| | Present Example | Comparison |
| Amount charged | 100 kg | 40 kg |
| Temperature in vicinity of A | 2800° C. | 1600° C. |
| Time for arrival at highest temperature | 30 minutes | 60 minutes |
| Time required for incineration | 1 minute (explosive) | 90 minutes |
| Incineration residue | only cans left in brittle pieces state | cans retaining original shape, melted viscous materials, large quantity of ash |
| Harmful exhaust gas composition | | |
| $Cl_2$ | 400 (ppm) | 30 (ppm) |
| CO | 0 | — |
| $NO_x$ | 250 | 100 |
| $SO_x$ | 100 | 60 |

EXAMPLE 8

About 10 kg of frozen fish entrails were charged in the furnace shown in FIG. 4, to which the flame-ionizing materials of Example 2 was attached. In a moment, large quantities of steam and other gases were generated. The entrails were completely burnt with a small amount of ash being left.

INDUSTRIAL APPLICABILITY

According to the present invention, a temperature much higher than the temperature attainable by a usual combustion flame (neutral flame) can be obtained by a simple method using a usual fuel without the necessity of the large electric power (electric discharge) required in the conventional plasma-utilizing furnace. Accordingly, the present invention is very valuable for an incineration and other operations for which a high temperature is necessary. For example, the present invention can be effectively utilized for an incineration of industrial wastes and decomposing matter having a high water content, and in other industrial fields where a high temperature is necessary, for example, the metallurgical and ceramic industries. Moreover, it is expected that the product of the present invention will be used as an ion-generating source for an ion-propelled engine and as a semiconductor.

What is claimed is:

1. A high temperature-generating method comprising bringing a combustion flame of a hydrocarbon into contact with a flame-ionizing material formed by molding a composition comprising a magnetic substance and a substance, the specific electric resistance of which is varied under irradiation with radioactive rays, and sintering the molded body in an oxidative atmosphere, and said method further comprising applying a magnetic field to the combustion flame.

2. A high temperature-generating method according to claim 1, wherein the hydrocarbon combustion flame is further irradiated with radioactive rays, while bringing the flame into contact with the flame-ionizing material and applying the magnetic field thereto.

3. A high temperature-generating method according to claim 2, wherein the combustion of the hydrocarbon is carried out by supplying an excess of oxygen to the hydrocarbon.

4. An incineration method for burning wastes comprising burning said wastes at a high temperature generated by bringing a combustion flame of a hydrocarbon, formed in an excess of oxygen, into contact with a flame-ionizing material formed by molding a composition comprising a magnetic substance and a substance, the specific electric resistance of which is varied under irradiation with radioactive rays, and sintering the molded body in an oxidative atmosphere;

and applying a magnetic field to and irradiating the combustion flame with radioactive rays while bringing the flame into contact with the flame-ionizing material.

5. A high temperature-generating apparatus comprising a flame-generating means for generating a flame by burning a fuel, a flame-ionizing material arranged at a position at which the flame is brought into contact therewith, said flame-ionizing member being formed by molding a composition comprising a magnetic substance and a substance, the specific electric resistance of which is varied under irradiation with radioactive rays, and sintering the molded body in an oxidative atmosphere, and a magnetic field generating means for applying a magnetic field to the flame.

6. A high temperature-generating apparatus as set forth in claim 5, which further comprises a radioactive ray-generating means.

7. A high temperature-generating apparatus comprising a cylinder composed of a refractory material, the inner surface of which is lined with a flame-ionizing material formed by molding a composition comprising a magnetic substance and a substance, the specific electric resistance of which is varied under irradiation with radioactive rays, and sintering the molded body in an oxidative atmosphere, and a combustion flame injection nozzle and a magnetic-field generating means, which are arranged in the interior of the cylinder.

8. A high temperature-generating apparatus as set forth in claim 7, which further comprises a radioactive ray-generating means arranged in the cylinder.

* * * * *